US006305306B1

(12) United States Patent
Grzybowski

(10) Patent No.: US 6,305,306 B1
(45) Date of Patent: Oct. 23, 2001

(54) WATERCRAFT STABILIZER SYSTEM

(76) Inventor: Joseph Michael Grzybowski, 9 Van Buren Rd., Scotia, NY (US) 12302

( * ) Notice: Subject to any disclaimer, the term of this patent is extended or adjusted under 35 U.S.C. 154(b) by 0 days.

(21) Appl. No.: 09/600,100

(22) PCT Filed: Jan. 27, 1999

(86) PCT No.: PCT/US99/01773

§ 371 Date: Jul. 11, 2000

§ 102(e) Date: Jul. 11, 2000

(87) PCT Pub. No.: WO99/38765

PCT Pub. Date: Aug. 5, 1999

(30) Foreign Application Priority Data

Jan. 30, 1998 (GB) ..... 98018948

(51) Int. Cl.[7] ..... B63B 43/14
(52) U.S. Cl. ..... 114/123; 114/283
(58) Field of Search ..... 144/123, 343, 144/344, 347, 364, 283

(56) References Cited

U.S. PATENT DOCUMENTS

| | | | | |
|---|---|---|---|---|
| 655,234 | * | 8/1900 | Howe et al. | 114/123 |
| 4,641,594 | * | 2/1987 | Birkett | 114/43 |
| 4,862,818 | * | 9/1989 | Sullivan | 114/347 |
| 5,295,454 | * | 3/1994 | Streck | 114/123 |
| 5,501,169 | * | 3/1996 | Denker | 114/364 |
| 5,829,376 | * | 11/1998 | Kostanski | 114/61 |

FOREIGN PATENT DOCUMENTS

| | | | | |
|---|---|---|---|---|
| 586995 | * | 11/1959 | (CA) | 114/123 |

* cited by examiner

*Primary Examiner*—Jesus D. Sotelo
(74) *Attorney, Agent, or Firm*—Our Pal® Asija

(57) ABSTRACT

This invention comprises methods, devices and systems for stabilizing watercraft. More particularly it comprises a means for stabilizing a canoe or the like watercraft (100) with a pair of flotation devices (250) shaped like a SKI (242) at the bottom or mount over SKIs (240). The floats (250) are interfaced to the watercraft at interface (210) via a longitudinal support member (200) foldable in for stowing and foldable out for deployment via hinges (220).

1 Claim, 6 Drawing Sheets

WATERCRAFT STABILIZER SYSTEM

RELATED DOCUMENT

This invention is related to and based upon a United Kingdom national application 98018948 GB filed Jan. 30, 1998 in England as the inventor was then residing in England and reduced the invention to practice in England.

BACKGROUND

This invention relates to methods, device and systems for stabilizing watercraft. More particularly it relates to a means for stabilizing a canoe or the like watercraft and includes a portable, articulated, heavy-duty and versatile mounting bracket which can be rapidly mounted and dismounted on a small watercraft with a pair of float units. The facile mounting of suitable accessory floats on the articulated outer strut arms of the mounting bracket transforms the unit into a versatile and compact flotation device.

TECHNICAL CHARACTER

The technical character of this invention resides in the design and utility of a pair of float units as a means for stabilizing a watercraft which float unit is easily and quickly attachable and stow-able in the watercraft.

THE PROBLEM

The problems with prior art boat stabilizers such as those utilizing foam or hull modification are not suitable for majority of trekkers. The prior art stabilization and portage systems all fall short of fulfilling the needs of the average trekker.

SUMMARY

This invention comprises a pair of floats individually engage-able and deploy-able on opposite sides of the watercraft near the center of gravity. Either float or neither or both can be deployed (folded out) or stowed away (folded in) without any interference with the normal operation of the watercraft. The bottom of the floats is shaped like SKI's. The width of the Ski determines the speed range of the watercraft. Suitable mounting hardware for quick release and deployment is included. While the preferred embodiment is a unitary design, an alternate embodiment with plurality of floats on each side requires assembly of components and is particularly suitable for high speeds.

The width of the SKI's is inversely proportional to the speed. The normal skis are suitable for emergency rescue services and sportsmen in severe conditions or for slow moving and stationary watercraft use. Very thin knife edge SKI's are suitable for non-severe conditions at all speeds. An alternate embodiment is suitable for high speeds and is typically a few inches above the water, which comes into play for turning the watercraft to which it is attached at high speeds. Splashing and spray problems of lower speeds are minimal at high speeds.

PRIOR ART

A prior art patentability search was commissioned and conducted by the inventor. Furthermore the inventor is intimately familiar with the prior art. Following is a listing of the typical prior art arranged in the reverse chronological order for ready reference of the reader.

a) U.S. Pat. No. 5,829,376 awarded to Jerzy Kostanski on Nov. 3, 1998 for "Outrigger Watercraft"

b) U.S. Pat. No. 5,826,529 bestowed upon James Ely on Oct. 27, 1998 for "Stabilizing Hull for Watercraft"

c) U.S. Pat. No. 5,803,006 honorably given to Monsour Al-Dokhi on Sep. 8, 1998 for "Float Master for a Watercraft"

d) U.S. Pat. No. 5,647,297 earned by William Hanson on Jul. 15, 1997 for "Foam Stabilized Watercraft"

e) U.S. Pat. No. 5,582,126 honorably issued to Donald Rypinski on Dec. 10, 1996 for "Modular Watercraft System"

f) U.S. Pat. No. 5,501,169 showered upon James Denker on Mar. 26, 1996 for "Universal Canoe Accessory Mounting Bracket"

g) U.S. Pat. No. 5,295,454 granted to Donald Streck on Mar. 22, 1994 for "Safety Release Outrigger Attachment for an Outrigger Canoe"

h) U.S. Design Pat. No. D-341,813 designed by Schlangen et al on Nov. 30, 1993 for "Pontoon for Personalized Watercraft"

i) U.S. Design Pat. No. D-322,773 issued to Kissel et al on Dec. 31, 1991 for "One Man Outrigger Canoe"

j) U.S. Pat. No. 4,977,844 bestowed upon Richard Barr on Dec. 18, 1990 for "Life Step Stabilizer"

k) U.S. Pat. No. 4,807,551 creatively earned by Gwyn Ace of Canada on Feb. 28, 1989 for "Portable Outrigger"

l) U.S. Pat. No. 4,641,594 honorably issued to Harry Birkett on Feb. 10, 1987 for "Canoe Conversion Kit"

m) U.S. Pat. No. 4,512,277 honorably given to Donald Williams on Apr. 23, 1985 for "Adjustable Canoe Pontoons"

Unfortunately none of the prior art devices singly or even in combination provide all of the features and objectives established by the inventor for this system as enumerated below.

OBJECTIVES

1. It is an objective of this invention to provide method, devices and system for increasing the stability of a aircraft.

2. Another objective of this invention is to provide a watercraft stabilizer system suitable for all types of bodies of water and all types of watercraft for operation at low, medium and high speeds.

3. Another objective of this invention is that it use little or no additional power or energy.

4. Another objective of this invention is that it is easy to use even for novices and beginners and therefore requires little additional training.

5. Another objective of this invention is that the stabilizer system of this invention is integrated and streamlined to the watercraft.

6. Another objective of this invention is that it be physically safe in normal environment as well as accidental situations.

7. Another objective of this invention is that it be environmentally friendly.

8. Another objective of this invention is that it be made of modular units easily interface-able to each other.

9. Another objective of this invention is that it meet all federal, state, local and other private standards, guidelines and recommendations with respect to safety, environment, quality and energy consumption.

10. Another objective of this invention is that it permit safe operation in inclement weather conditions such as turbulence.

11. Another objective of this invention is that it be elegantly simple in concept and design.

12. Another objective of this invention is that it be applicable to retrofit as well as OEM market.

13. Another objective of this invention is that it be easy to install, de-install, deploy, stow, transport and store.

14. Another objective of this invention is that it can be adapted for other uses.

15. Another objective of this invention is that the floatation device is easily separable in case of emergency to serve as life preserver.

16. Another objective of this invention is to only minimally interfere with the cruise speed of the watercraft.

Other objectives of this invention reside in its simplicity, elegance of design, ease of manufacture, service and use and even aesthetics as will become apparent from the following brief description of the drawings and concomitant description.

DISCUSSION OF PRIOR ART

Existing flotation devices do not fulfill the needs of the average small, narrow beam watercraft user. Small, narrow beam watercraft are typically more susceptible to being swamped or capsized than other small watercraft. Anti-roll, anti-list, and anti-swamp stability can be achieved in a small, narrow beam watercraft using pontoons, sponsons, floats, or float units fixed to a mounting bracket which in turn is fixed to the hull of these craft. These flotation devices (mounting bracket plus the attached float units) have typically been of a fixed nature, vertically adjustable, or laterally extendable from the side of the hull.

Many of the existing float units are custom-made, and are, therefore not universally applicable to small, narrow beam watercraft. The floats are of differing sizes and shapes but in general they are rather bulky to handle and/or provide substantial hydrodynamic drag to the vessel.Typically, these flotation devices do not allow the float units to be readily engaged or disengaged while the vessel is in motion. The float units are not readily stow-able for launching, docking, or beaching the small, narrow beam watercraft. The flotation devices are typically not designed to facilitate the easy manoeuvering of the small, narrow beam watercraft in areas obstructed with rocks, brush, trees, and debris.

The majority of existing flotation devices do not provide a means for stowing the float units in a manner, which will prevent the small, narrow beam watercraft from listing appreciably to one side, while stowing or removing the float units. The stowing of float units is necessary to permit the unobstructed passage of the small, narrow beam watercraft past waterside obstacles located to either side of the hull while minimizing the possibility of them being fouled.

The Pontoons of Williams '277 are not readily suitable for launching and docking or beaching a small watercraft such as a canoe. Neither are the pontoons easily removable while remaining seated in a stationary position in the canoe to maintain the center of gravity along the longitudinal center line of the watercraft. It is thus not feasible to maneuver in areas obstructed by brush, rocks and the like.

ACE '551 has an extendable arm on the pontoons, which can be adjusted in and out only when the gunwale mounting clamp is loosened because it is firmly affixed to the inner (slidable telescopic rod. It cannot be adjusted while the craft is being operated.

The Invention of Barr '844 is always affixed either under or over the thwart and attached to a custom fitted float under by design may provide excess hydrodynamic drag. The float is custom fitted to one particular canoe shape and the float is quite bulky when in the engaged position and is therefore not universally applicable.

An embodiment of his invention requires cutting a hole through the hull of the craft. Second embodiment entails the clamping of the outer sleeve to the structural thwart of the canoe.

Denker '169 provides a universal mounting bracket that is clamped to the gunwale only on one side.

BRIEF DESCRIPTION OF THE DRAWINGS

The objects, features, and advantages of the present invention and its application will be more readily appreciated when read in conjunction with the accompanying drawing, in which:

a) FIG. 1(*a*) is an isometric perspective view of a pair of knife edge float units mounted and deployed on a prior art watercraft.

Figure 1A:
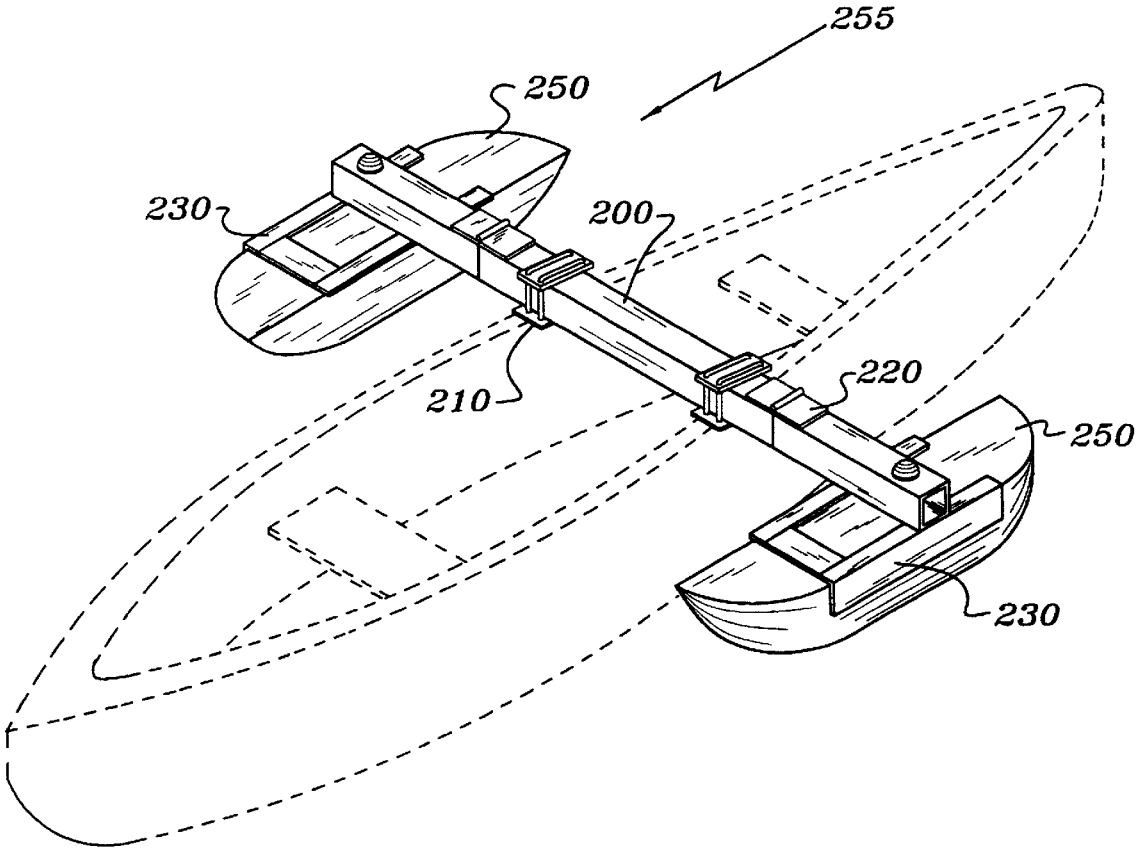
Figure 1B:
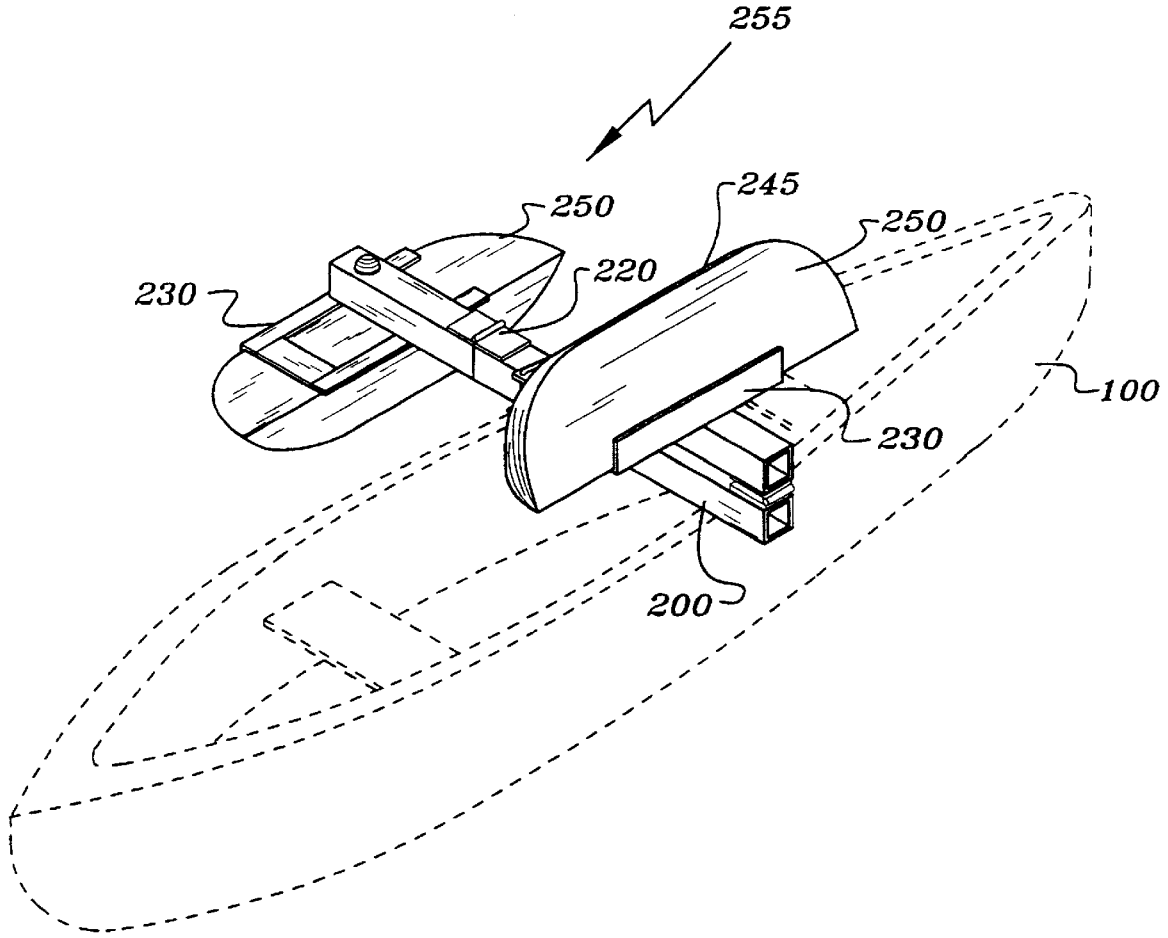
Figure 2D:
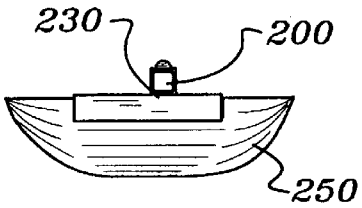
Figure 2A:
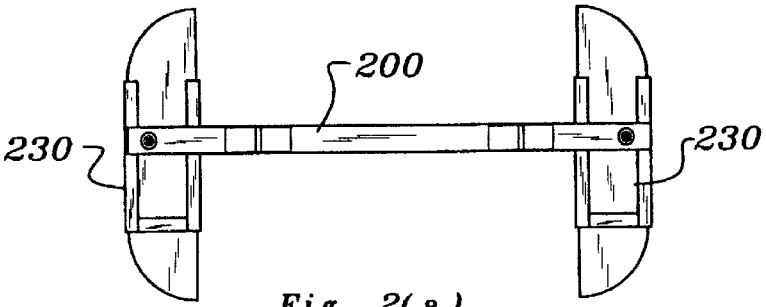
Figure 2B:
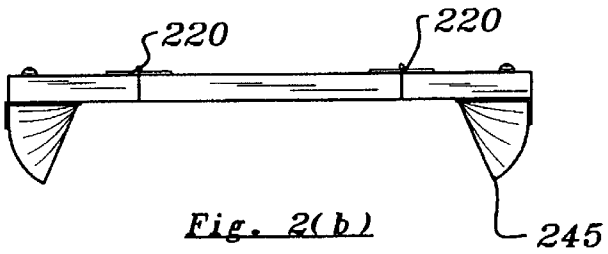
Figure 2C:
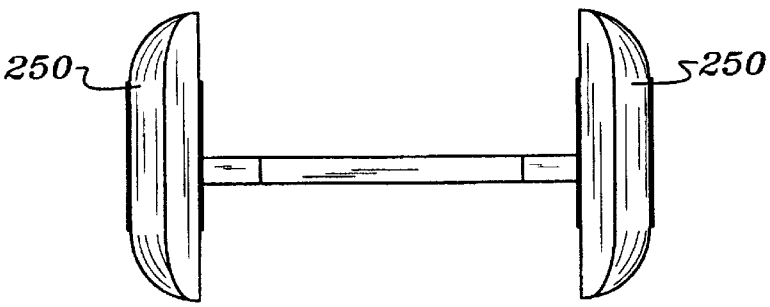
Figure 3:
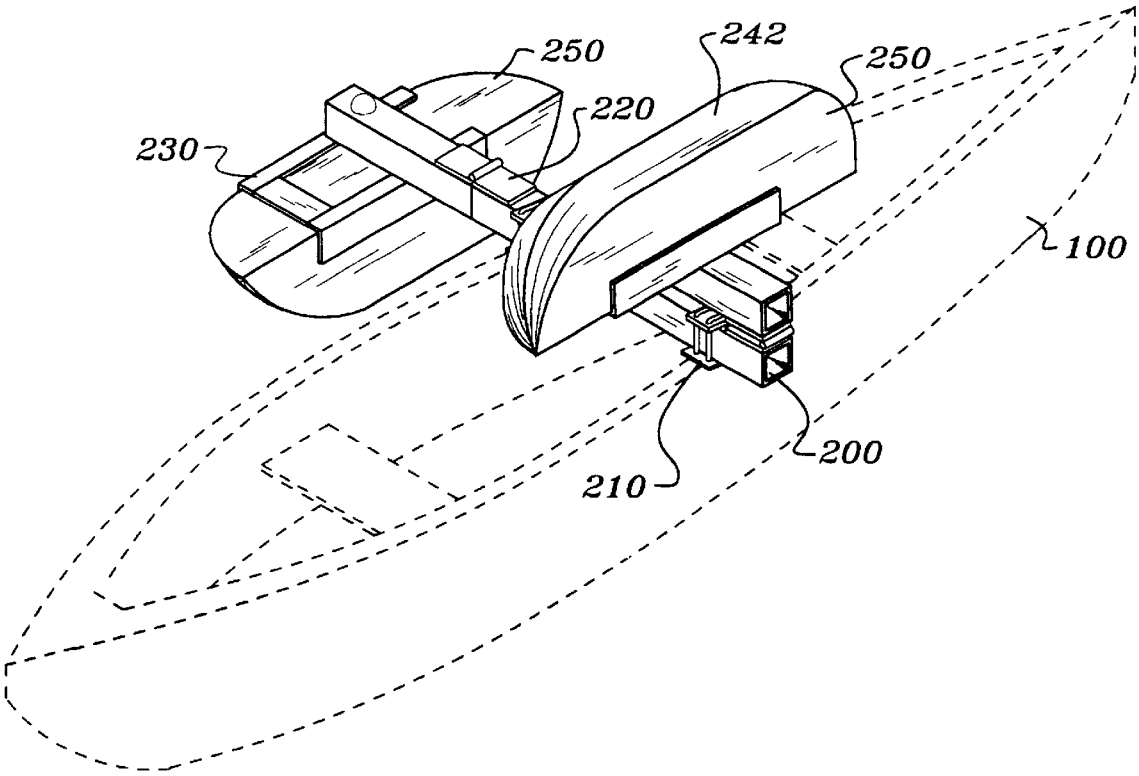
Figure 4:
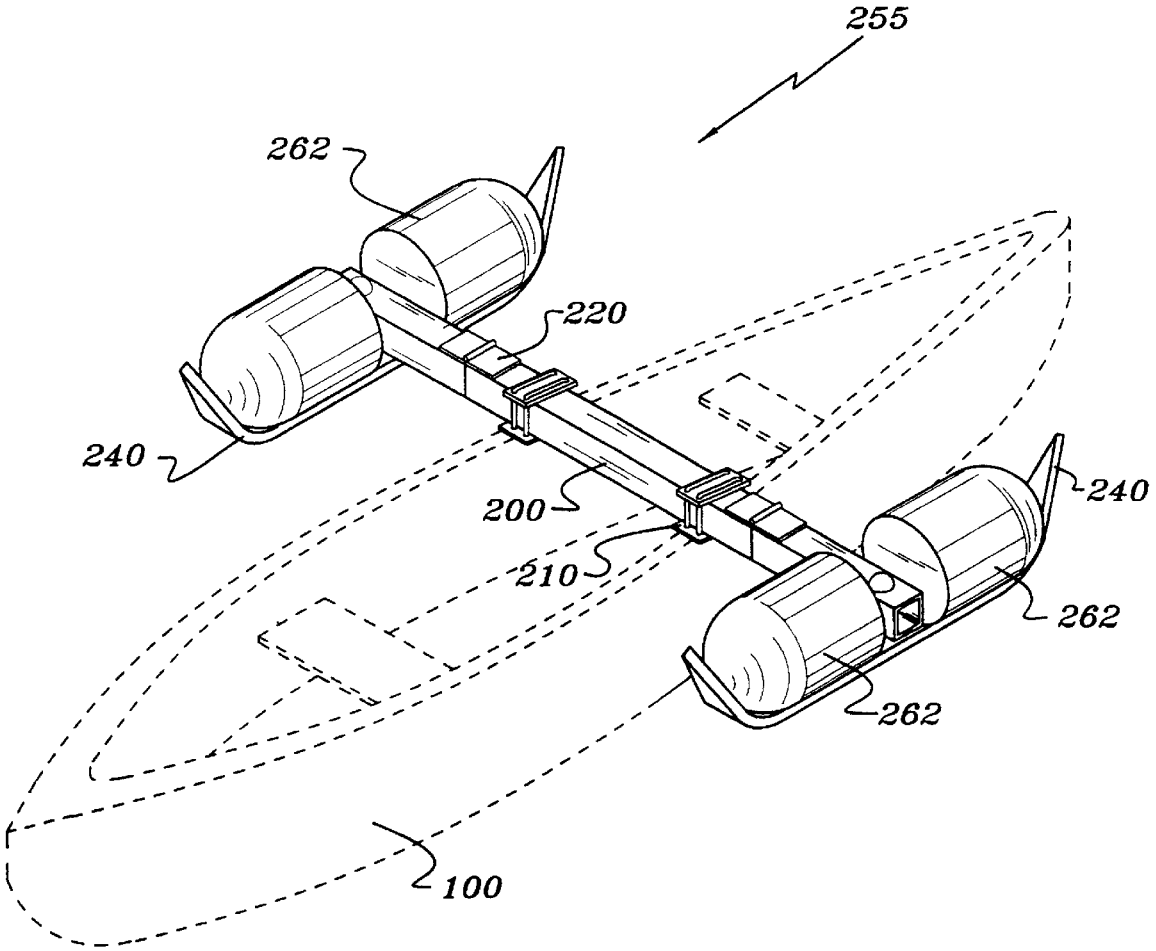
Figure 5C:
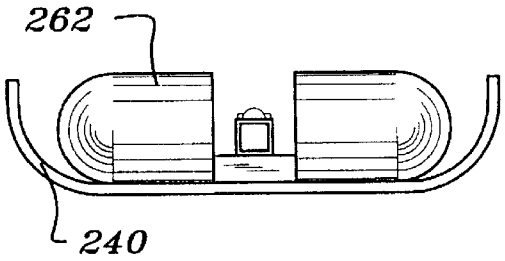
Figure 5A:
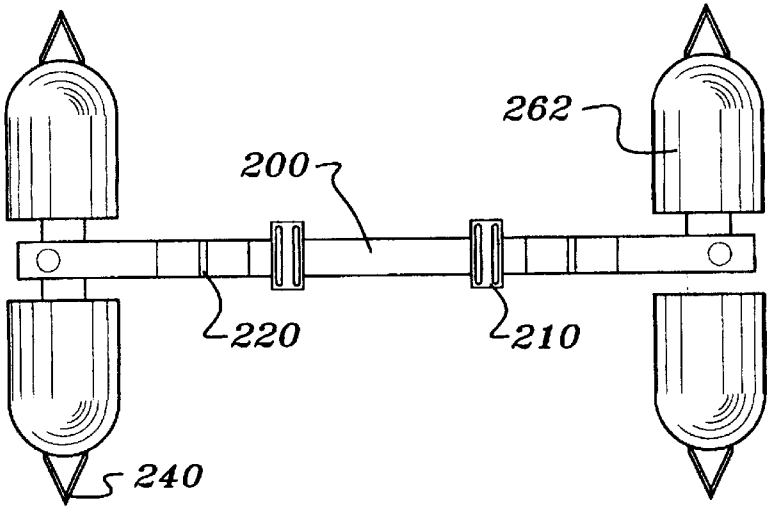
Figure 5B:
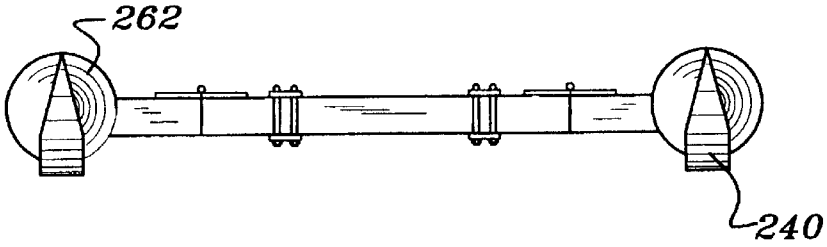

b) FIG. 1(*b*) is also an isometric perspective view of a unitary design having a pair of float units, one of which deployed and the other in stowed position.

c) FIG. 2(*a*) is top plan elevation of FIG. 1(*a*) without the watercraft.

d) FIG. 2(*b*) is a front from stern or back from bow view thereof.

e) FIG. 2(*c*) is a bottom elevation thereof.

f) FIG. 2(*d*) is a port side or starboard side view thereof.

g) FIG. 3 is an isometric perspective view of an alternate unitary design with standard SKIs for lower speeds of non-severe condition.

h) FIG. 4 is yet another isometric perspective view of an alternate embodiment of assembly of components non-unitary design embodiment wherein flotation device comprises a pair of air bladders over each ski on each side of the watercraft.

i) FIG. 5(*a*) is top plan elevation of FIG. 4 without the watercraft.

j) FIG. 5(*b*) is a front view form stern or back view from bow.

k) FIG. 5(*c*) is a port side or starboard side view thereof.

DETAILED DESCRIPTION OF THE PREFERRED EMBODIMENT

The watercraft stabilizer system of this invention as shown in the various drawings wherein like numerals represent like parts throughout the several views, there is generally disclosed in FIG. 1(*a*) is an isometric perspective view of a pair of float units 255 devices 250 mounted and deployed on a prior art watercraft 100. FIG. 1(*b*) is also an isometric perspective view of pair of float units 255 one of which is deployed and the other in stowed position. This embodiment is particularly suited for low speed or stationary operation in severe conditions.

FIG. 2(*a*) is top plan elevation of FIG. 1(*a*) without the watercraft. Similarly FIG. 2(*b*) is a front view from stern or back view from bow view thereof. FIG. 2(*c*) is a bottom elevation thereof. FIG. 2(*d*) is a port side or starboard side view thereof each complete with float units 255 mounted on the ends of longitudinal support member 200, which is interfaced to the watercraft at 210 and to the floats 260 at interface 230. The longitudinal support member has a pair of fold-able hinges 220 to quickly deploy (fold out) or stow (fold in) individually or collectively the float units 255.

FIG. 3 is an isometric perspective view of an alternate unitary design with standard SKIs for lower speeds under all conditions.

FIG. 4 is yet another isometric perspective view of an alternate embodiment wherein floatation devices 250 which comprises a pair of air bladders 262 over each ski 240 on each side of the watercraft 100. This embodiment is particularly suited for high speed operation in non-severe conditions.

FIG. 5(*a*) is top plan elevation of FIG. 4 without the watercraft. FIG. 5(*b*) is a front view from stern or back view from bow. FIG. 5(*c*) is a port side or starboard side view thereof complete with longitudinal support member 200, which is interfaced to the watercraft at 210 and to the float units 255 at interface 230. The longitudinal support member has a pair of fold-able hinges 220 to quickly deploy (fold out) or stow (fold in) individually or collectively.

ALTERNATE EMBODIMENTS

FIG. 3 is an isometric perspective view of an alternate unitary design with standard SKIs for lower speeds of all conditions.

As shown in FIG. 4 instead of a unitary design the floats may comprise an assembly of components. This is particularly suited for high speed operation.

According to the present invention, the floats 260 can be of a unit body construction as shown in FIGS. 1, 2 & 3 or an assembly of components as shown in FIGS. 4 & 5. Ideally, the floats 260 should be lightweight and compact in keeping with the overall portable nature of the flotation device, and the small narrow beam watercraft. They need not be custom-made to fit each small, narrow beam watercraft.

The displacement capacity of the floats is determined by the severity of the operating conditions. For average operating conditions, the floats can be up to about fifty liters, or more, of displacement capacity and up to about one meter in length. The floats should be square, rectangular, or approximately cylindrical in overall shape with the anterior or forward portion being shaped similar to the floats illustrated. In special cases the float should be symmetrically shaped with both the anterior and posterior sections being shaped similar to the anterior section of the floats illustrated.

Either a suitably designed float, or fixture (such as a ski) securely fastened to the bottom of a float will enable a small, narrow beam watercraft to achieve safe and stable operating characteristics at both low and high speed. Such a float reduces hydrodynamic drag, splashing and spray under various operating conditions of the small, narrow beam watercraft.

This invention provides a design for a general purpose float which can achieve these characteristics when it is incorporated into the overall flotation device 250.

Virtually any reasonable type, size, and shape of float can be rapidly and easily fixed to the float unit, either with float mounting fasteners or float mounting clamps to either the outer strut arm or the adjustable extension arm.

Owing to the lightweight nature of a small, narrow beam watercraft, mounting of this flotation device makes it extremely buoyant. Thus, the one crew member (of average weight) on board the vessel and minimum cargo carried, is easily supported. There can be up to about 100 Kg of flotation life to support the crew member and cargo in a small, narrow beam watercraft from the floats described. Similarly, if a small, narrow beam watercraft is rendered unserviceable and must by abandoned while in deep waters, the flotation device can be dismounted from the vessel during the emergency.

It can then be readily utilized as a secondary personal flotation device. In this manner the flotation device can be utilized to help maintain the crew member afloat till help arrives, or to enable the crew member to swim to shore more easily, since the crew member can take rest breaks when necessary while relying on the flotation device. This is in combination with the primary personal flotation device (life Jacket) which should always be worn by all crew members.

This flotation device permits the effective beam of a small, narrow beam watercraft to be approximately doubled when both float units are engaged and locked.

Likewise, the beam of the vessel is returned to normal when both of the float units are disengaged and stowed. The inherent improvement in safety benefits and vessel manoeuvering characteristics, under variable water conditions, are obvious for such a device.

If a catastrophic event causes a small, narrow beam watercraft with the mounted flotation device to be capsized, it can be readily returned to an upright condition. The crew member can then mount the vessel, bail out the excess water and return the vessel to normal use with only moderate time and effort expended to achieve this under average conditions. Even if severe conditions persist the flotation device will aid in maintaining the vessel in an upright orientation.

The float units 255 constitute everything from hinge out and are comprised of the float and any float mounting fasteners or float mounting clamps, a suitably long extension arm (needed to provide adjustment of the height of the float), and any fasteners and quick connect fasteners for float height adjustment.

Angle fixtures are used to securely fasten the extension arm to the outer strut arm which is also defined as a part of the float unit for convenience.

The float units are designed and adjusted to provide the optimum compromise between minimizing the list of the small, narrow beam watercraft, and the hydrodynamic drag which naturally ensues.

They can be engaged and disengaged, and are stow-able at a position where they typically will not interfere with the small, narrow beam watercraft's manoeuvering capabilities. Furthermore, the float units can be engaged and locked in such positions rapidly, and with minimum effort, and be unlocked, disengaged and stowed rapidly when not required. These operations can be performed while the small, narrow beam watercraft is in motion, since the crew member can remain seated in a stationary position, and thus maintain the center of gravity along the longitudinal center line of the vessel while performing the necessary operations.

A float unit is locked in the engaged configuration with a positive-locking latch or catch or, according to the preferred embodiment of the invention, a locking strut which permits the remote locking of the float unit.

THE USE AND OPERATION

This invention also provides a means in which float units attached to the mounting bracket are articulated or hinged and, therefore, can be folded and stowed in a position near to the longitudinal center line of the small, narrow beam watercraft, thereby minimizing its list, regardless of the float units being in the engaged or disengaged position.

The operation, utility and use of the invention is obvious. Nonetheless the inventor recommends the following steps.

a) Turn the watercraft upright and lay the fully assembled flotation device (including the mounting bracket) in the bottom of the small water craft.

b) Fasten the flotation device in the watercraft with a pair of rubber bungee or elastic cords.

c) Invert the water craft and mount securely on a car top watercraft carrier.

d) Remove the watercraft from the car at the desired body of water at the destination and turn the water craft upright.

e) Unfasten the flotation device from the watercraft.

f) Mount the flotation device so as not to interfere with engine, paddles, oars, passengers or otherwise normal intended operation of the watercraft.

g) Engage the engine and one or both float units when the watercraft is over a suitable depth of water.

Naturally the reverse process is employed at the end of the excursion for the return trip home.

A small, narrow beam watercraft which is fixed with this flotation device could be invaluable to emergency rescue services and rescue workers in such cases and on waterways where ice and water (winter conditions) coexist making rescues difficult or extremely hazardous.

The weight and shape of the small, narrow beam watercraft with the mounted flotation device make it a cost effective rescue tool for people who break through thin ice and are in danger of drowning, or to approach them from a shore which is irregularly shaped from the ice and snow formations. The small, narrow beam watercraft can be poled across the ice regardless of the thickness of the ice (owing to the weight, shape and anti-list stability of the vessel).

The crew member can remain on board the vessel while poling, paddling or rowing (owing to the weight and shape characteristics of the small, narrow beam watercraft), thereby minimizing personal danger in manoeuvering between ice and open water, and even semi-open water.

The floats 260, 262 of the float units 255 should be symmetrical in this case, conforming to the anterior section design to achieve satisfactory performance. A suitable strength line, which is attached to the vessel, can be thrown or shot to safe ground where backup rescue workers can help pull the vessel and occupants to safety.

The suitably designed and totally assembled flotation device can be dismounted from the small, narrow beam watercraft and securely stowed inside the hull for protection and transport. The vessel can then be oriented in a suitable manner, including upside-down, mounted on a motor or other vehicle, secured, and safely transported to any desired destination with the flotation device safely stowed inside the hull.

Although the invention presented here is developed for use with small, narrow beam watercraft, portions of this invention can be utilized quite effectively with other watercraft. The flotation device can be extremely useful when fixed to a small, narrow beam watercraft, it may be of marginal use for larger beam watercraft.

However, various subsystems, such as the clamps or mounting bracket, of the flotation device can be very useful on larger beam watercraft. The mounting bracket and clamps can be readily fitted to any watercraft, which possesses a T-shaped or inverted L-shaped gunwale, to provide a portable and heavy-duty mount for other accessories (such as a sailing conversion kit) which could be very useful on the larger watercraft.

Finally, either the accessories or the mounting bracket utilized to mount the accessories can be designed with a deliberately breakable component (frangible link), such as the clamp fasteners, which will sheer under levels of stress which are slightly below those at which the gunwale or hull of the watercraft will be irreparably damaged. The accessory will thus break away and detach from the watercraft before irreparable damage can occur.

Many possible variations in design details and materials can alter the appearance and the manufacturing costs of the device without any real change to its function.

The inventor has given a non-limiting description of this invention. Due to the simplicity and elegance of the design of this invention designing around it is very difficult if not impossible. Nonetheless many changes may be made to this design without deviating from the spirit of this invention. Examples of such contemplated variations include the following:

1. The shape and size of the various members and components may be modified.
2. The color, aesthetics and materials may be enhanced or varied.
3. The SKIs may be of strong light weight rigid material and optionally airfoil shaped.
4. Additional complimentary and complementary functions and features may be added.
5. The SKIS may be stowed differently.
6. The SKIs may be made telescopic.
7. The SKIs may be in modular sections differently.
8. The flotation device may be modified in quantity and quality.
9. The flotation device may be interfaced to the watercraft differently.
10. The longitudinal member may be interfaced to the watercraft differently.
11. Folding may be performed differently.
12. The longitudinal member interface to the flotation device may be modified.

Other changes such as aesthetics and substitution of newer materials as they become available, which substantially perform the same function in substantially the same manner with substantially the same result without deviating from the spirit of the invention may be made.

Following is a listing of the components used in this embodiment arranged in ascending order of the reference numerals for ready reference of the reader.

100=Watercraft generally

200=Longitudinal Support Member Strut

210=Support member interface to the watercraft

220=180 degree Fold-able Hinge

230=Support member interface to the floats.

240=SKI

242=Ski shaped bottom of unitary float design.

244=Knife edge shaped ski under unitary float design

245=Knife edge

250=Flotation device or floats

255=Float unit everything from hinge fulcrum out.

260=Unitary Float

262=Air Bladder in assembly of components embodiment

DEFINITIONS AND ACRONYMS

A great care has been taken to use words with their conventional dictionary definitions. Following definitions are included here for clarification.

3D=Three Dimensional

Airfoil=A body shaped to produce lift as it travels through the air.

BOW=Front of a watercraft

Gunwale=The upper edge of the watercraft

Hydrofoil=Ski like members mounted at the bottom of a watercraft.

DIY=Do It Yourself

Integrated=Combination of two entities to act like one

Interface=Junction between two dissimilar entities

Port Side=Side of watercraft facing the land

Starboard side=Side of the watercraft facing the water.

Stern=The rear of a watercraft

Symmetrical=The shape of an object of integrated entity which can be divided into two along some axis through the object or the integrated entity such that the two halves form mirror image of each other.

Turbulence=Break up of laminar fluidic flow.

Unitary=A design of a single integrated unit.

While this invention has been described with reference to illustrative embodiments, this description is not intended to be construed in a limiting sense. Various modifications and combinations of the illustrative embodiments as well as other embodiments of the invention will be apparent to a person of average skill in the art upon reference to this description. It is therefor contemplated that the appended claim(s) cover any such modifications, embodiments as fall within the true scope of this invention.

What is claimed is:

1. A watercraft stabilizer device comprising:

a) a longitudinal support member mountable on to a watercraft;

b) a pair of floats connected to said longitudinal member on each end thereof; and c) wherein said floats comprise a pair of air bladders mounted over a ski on each side of said watercraft.

* * * * *